US009211711B2

(12) United States Patent
Kudo

(10) Patent No.: US 9,211,711 B2
(45) Date of Patent: Dec. 15, 2015

(54) LIQUID EJECTING HEAD AND LIQUID EJECTING APPARATUS

(71) Applicant: SEIKO EPSON CORPORATION, Tokyo (JP)

(72) Inventor: Yasuyuki Kudo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/711,271

(22) Filed: May 13, 2015

(65) Prior Publication Data

US 2015/0328895 A1 Nov. 19, 2015

(30) Foreign Application Priority Data

May 16, 2014 (JP) ..... 2014-102056

(51) Int. Cl.
*B41J 2/04* (2006.01)
*B41J 2/14* (2006.01)

(52) U.S. Cl.
CPC ..... *B41J 2/14201* (2013.01)

(58) Field of Classification Search
CPC ..... B41J 2/14274; B41J 2/14072; B41J 2002/14491; B41J 2/175; B41J 2/17526
USPC ..... 347/20, 50, 54, 57, 68
See application file for complete search history.

(56) References Cited

U.S. PATENT DOCUMENTS 8,746,846 B2 * 6/2014 Arakawa ..... 347/45
8,764,166 B2 * 7/2014 Miyajima et al. ..... 347/50

FOREIGN PATENT DOCUMENTS

JP 2006-082317 3/2006

* cited by examiner

*Primary Examiner* — An Do
(74) *Attorney, Agent, or Firm* — Workman Nydegger

(57) ABSTRACT

A liquid ejecting head includes an oscillation unit and a circuit board which is electrically connected to the oscillation unit within a case, in which the case includes ink introduction needles which are provided on a nozzle plate of an opposite side from a nozzle surface on which nozzles are formed and a liquid discharge path, one end of which is open in the base plate, and another of which extends to a nozzle surface side and is open toward an exterior of the case, and in which, while an opening of one end side of the liquid discharge path is positioned higher than the circuit board side in a vertical direction in the case, an opening of another end side of the liquid discharge path is positioned lower than the circuit board in the vertical direction in the case.

10 Claims, 4 Drawing Sheets

LIQUID EJECTING HEAD AND LIQUID EJECTING APPARATUS

The present application claims priority to Japanese Patent Application No. 2014-102056 filed on May 16, 2015, which is hereby incorporated by reference in its entirety.

BACKGROUND

1. Technical Field

The present invention relates to a liquid ejecting head such as in ink jet recording head, and a liquid ejecting apparatus. In particular, the invention relates to a liquid ejecting head provided with joining sections which are connected to a member which supplies a liquid, actuators as power sources for causing the liquid to be ejected, and a circuit board which is electrically connected to the actuators, and the invention relates to a liquid ejecting apparatus.

2. Related Art

The liquid ejecting apparatus is an apparatus which is provided with a liquid ejecting head, and which ejects various liquids from the ejecting head. An image recording apparatus such as an ink jet printer or an ink jet plotter is an example of the liquid ejecting apparatus; however, recently liquid ejecting apparatuses are also being adapted for use in various manufacturing apparatuses, making use of the characteristic of being capable of causing minute amounts of a liquid to accurately land on predetermined positions. For example, the liquid ejecting apparatus are being adapted for use in display manufacturing apparatuses which manufacture color filters of liquid crystal displays and the like, electrode forming apparatuses which form electrodes of organic electro-luminescence (EL) displays, face emission displays (FED), and the like, and chip manufacturing apparatuses which manufacture biochips (biochemical elements). In a recording head for an image recording apparatus, a liquid-state ink is ejected, and in a color material ejecting head for a display manufacturing apparatus, solutions of color materials for each of red (R), green (G), and blue (B) are ejected. In an electrode material ejecting head for an electrode forming apparatus, a liquid-state electrode material is ejected, and in a bio-organic matter ejecting head for a chip manufacturing apparatus, a solution of bio-organic matter is ejected.

There are various types of the liquid ejecting head; however, in a so-called on-demand system that is in wide use, a configuration is adopted in which a supply of the liquid is received from a liquid supply member (for example a liquid cartridge) in which the liquid is stored, guided into a liquid flow path inside a head, and the liquid inside the liquid flow path is ejected from nozzles by driving actuators such as piezoelectric elements or a heat emitting elements. In such a liquid ejecting head, electronic parts and the like such as a circuit board relating to the driving of the actuators are provided in addition to connecting portions (for example introduction needles) which are connected to a liquid supply member. Therefore, even in a rare case in which the liquid leaks from the connecting portions, it is important to prevent the liquid from flowing to the electronic part side. For example, JP-A-2006-082317 discloses a liquid ejecting head provided with a discharge opening which communicates with the head exterior in the location at which the connecting portions which are connected to the liquid supply source are provided, and further provided with a liquid absorbent material which absorbs the liquid in the periphery of the connecting portions, such that the liquid absorbent material covers the discharge opening. Accordingly, the liquid that leaks from the connecting portions and is absorbed by the liquid absorbent material is discharged from the head exterior through the discharge opening.

Incidentally, depending on the situation at the time of usage of a liquid ejecting apparatus with a liquid ejecting head mounted thereon, the apparatus is not necessarily in a horizontal orientation, and there is a likelihood that the apparatus will be installed in an inclined manner. In particular, in recent years, small, easy-to-carry liquid ejecting apparatuses have also been developed, and the orientation of the apparatus during carrying is not necessarily horizontal. Even in the configuration described above, depending on the orientation of the apparatus, there is a likelihood that, once the liquid is discharged from the discharge opening, the liquid will travel along the gaps between the components of the liquid ejecting head and flow to the electronic part side.

SUMMARY

An advantage of some aspects of the invention is to more reliably suppress flowing of leaked liquid to an electronic part side, regardless of the orientation of a liquid ejecting head.

According to an aspect of the invention, a liquid ejecting head includes an actuator which ejects a liquid from a nozzle, and a circuit board which is electrically connected to the actuator, in which the actuator and the circuit board are provided within a case of the liquid ejecting head, in which the case includes a joining portion which is provided on a second surface of an opposite side from a first surface on which the nozzle is formed and which is joined with a member which supplies the liquid, and a liquid discharge path, one end of which is open in the second surface, and another side of which extends from the second surface side to the first surface side and is open toward an exterior of the case, and in which, while an opening of one end side of the liquid discharge path is positioned closer to the joining portion side than the circuit board side in the case, an opening of another end side of the liquid discharge path is positioned on an opposite side from the joining portion side to interpose the circuit board.

According to the invention, since, while the opening of one end side of the liquid discharge path is positioned closer to the connecting portion side than the circuit board, the opening of the other side of the liquid discharge path is positioned on the opposite side from the connecting portion side to interpose the circuit board, in a rare case in which the liquid leaks from the connecting portion side, even if the orientation of the liquid ejecting head is inclined, in an extreme example, the orientation is vertically inverted, or the like, the leaked liquid does not easily reach an unintended region, that is, the circuit board in which electrical parts are installed, and it is possible to more reliably protect the circuit board from the liquid.

In this case, it is preferable that an absorbent material which absorbs the liquid is provided on the other end side of the liquid discharge path.

According to the configuration described above, since the liquid that is discharged from the liquid discharge path is absorbed by the absorbent material, the liquid which is held, once the liquid is ejected, flowing to the circuit board or the like is more reliably suppressed.

In this case, it is preferable that the case is provided with a holder which includes the joining portion, and a carriage which includes the actuator and the nozzle, and, that the liquid discharge path is provided in the holder, penetrates at least a portion of the carriage, and communicates with the exterior of the case.

According to the configuration described above, since the liquid discharge path penetrates at least a portion of the carriage and communicates with the exterior of the case, it is possible to suppress the enlargement of the entirety of the liquid ejecting head in comparison to a configuration in which a liquid discharge path for allowing the liquid to escape across the plurality of the components that form the liquid ejecting head is formed separately without penetrating each component.

In this case, it is preferable that the circuit board includes a connector to which wiring is connected, and that the connector is positioned on an opposite side from the liquid discharge path side to interpose the joining portion.

According to the configuration described above, since the connector is positioned on the opposite side from the liquid discharge path side to interpose the joining portion, even if leaking of the liquid occurs, it is possible to render it difficult for the liquid to flow to the connector.

It is preferable that the circuit board is disposed between the holder and the carriage.

According to another aspect of the invention, the liquid ejecting apparatus of the invention includes the liquid ejecting head of one of the configurations described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of an embodiment of the invention with reference to the attached drawings. Note that, in the embodiment described hereinafter, there are various limits as a favorable embodiment of the invention; however, the scope of the invention is not limited thereto as long as there is no wording particularly limiting the invention in the description hereinafter. Hereinafter, an ink jet printer (a printer 1) with an ink jet recording head (a recording head 3), which is a type of the liquid ejecting head, mounted thereon will be described as an example of the liquid ejecting apparatus of the invention.

Figure 1:
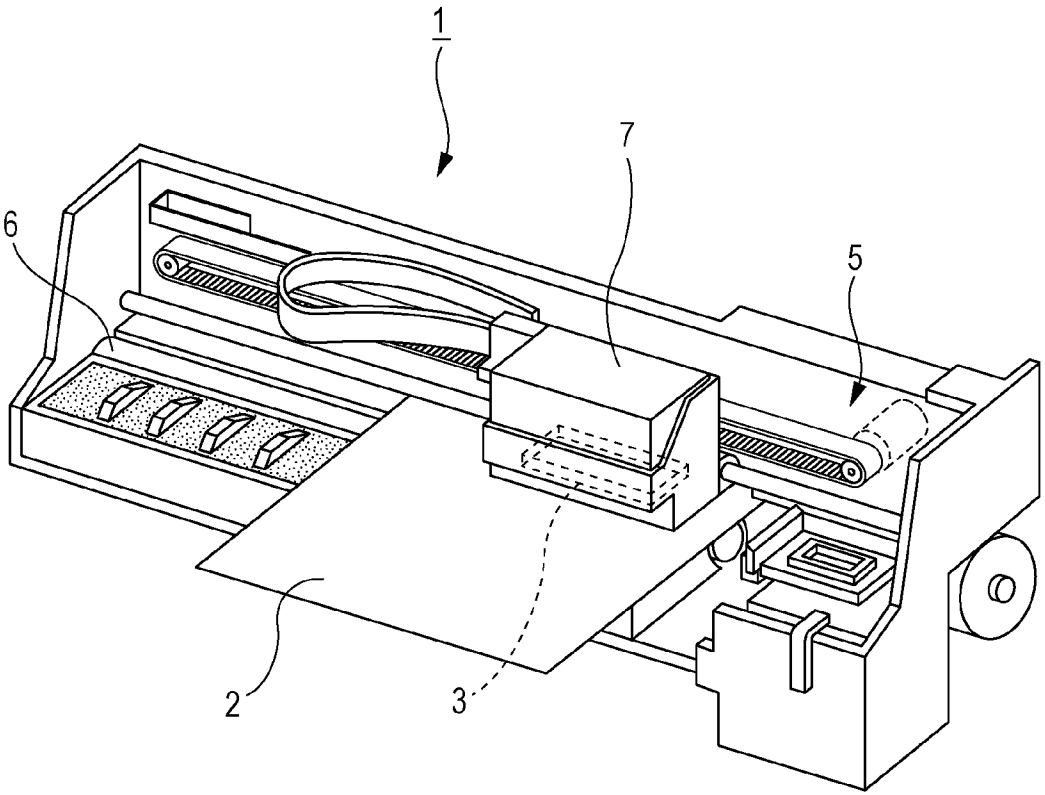
FIG. 1 is a schematic diagram illustrating the configuration of a printer.

Description will be given of the configuration of the printer 1 with reference to FIG. 1. The printer 1 is an apparatus which performs recording of an image or the like by ejecting a liquid-state ink onto the surface of a recording medium 2 (a type of landing target) such as recording paper. The printer 1 is provided with the recording head 3, a head scanning mechanism 5, a platen roller 6, and the like. The recording head 3 ejects an ink, the head scanning mechanism 5 causes the recording head 3 to move in a main scanning direction, and the platen roller 6 conveys the recording medium 2 in a sub-scanning direction. Here, the ink is a type of the liquid in the invention, and is stored in ink cartridges 7 which serve as members that supply the liquid (a liquid supply source). The ink cartridges 7 are detachably mounted to the recording head 3. Note that, a configuration may be adopted in which the ink cartridges 7 are disposed on a main body side of the printer 1, and the ink is supplied from the ink cartridges 7 to the recording head 3 through ink supply tubes. In this case, an intermediate member (a sub-tank) is provided between the ink supply tubes and the recording head 3. The intermediate member is provided with an adjustment valve which adjusts the supply pressure of the ink to the recording head 3. The intermediate member is also a type of member which supplies the liquid in the invention.

Figure 2:
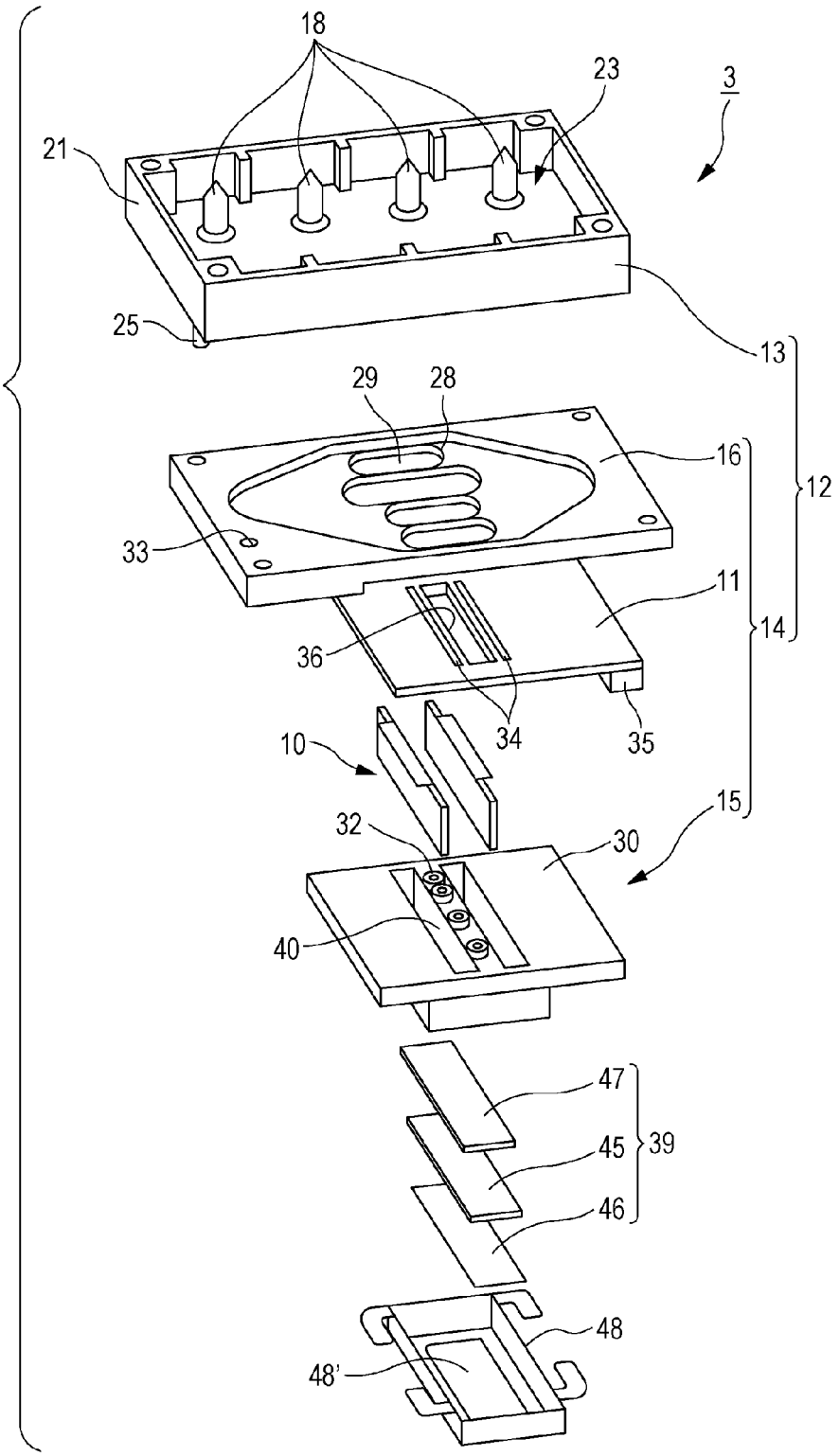
FIG. 2 is an exploded perspective diagram illustrating the configuration of a recording head.
Figure 3:
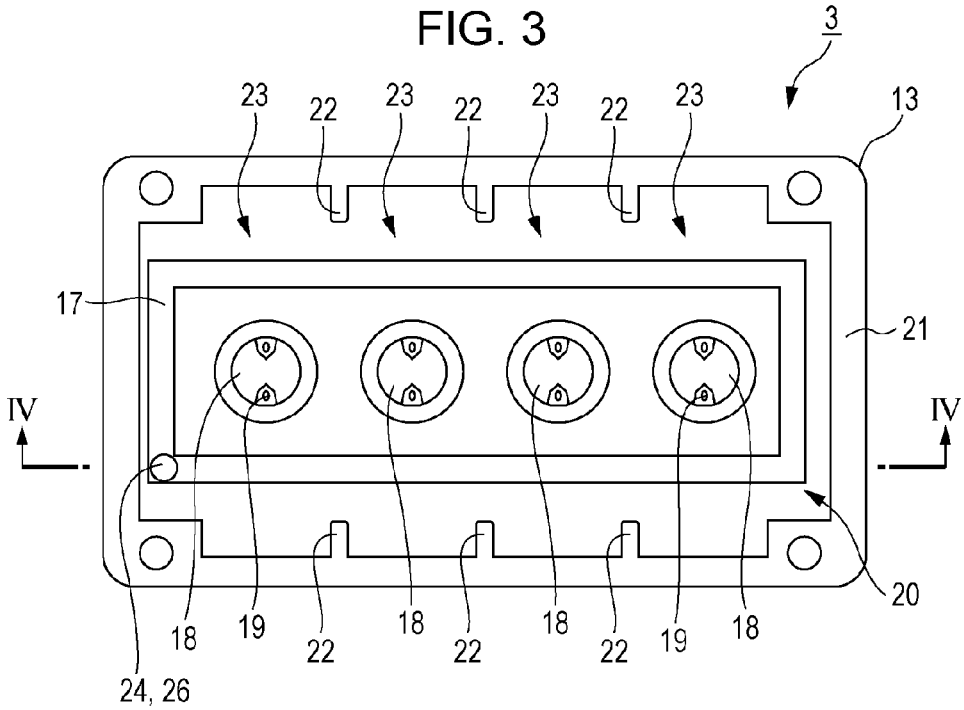
FIG. 3 is a top view of the recording head.
Figure 4:
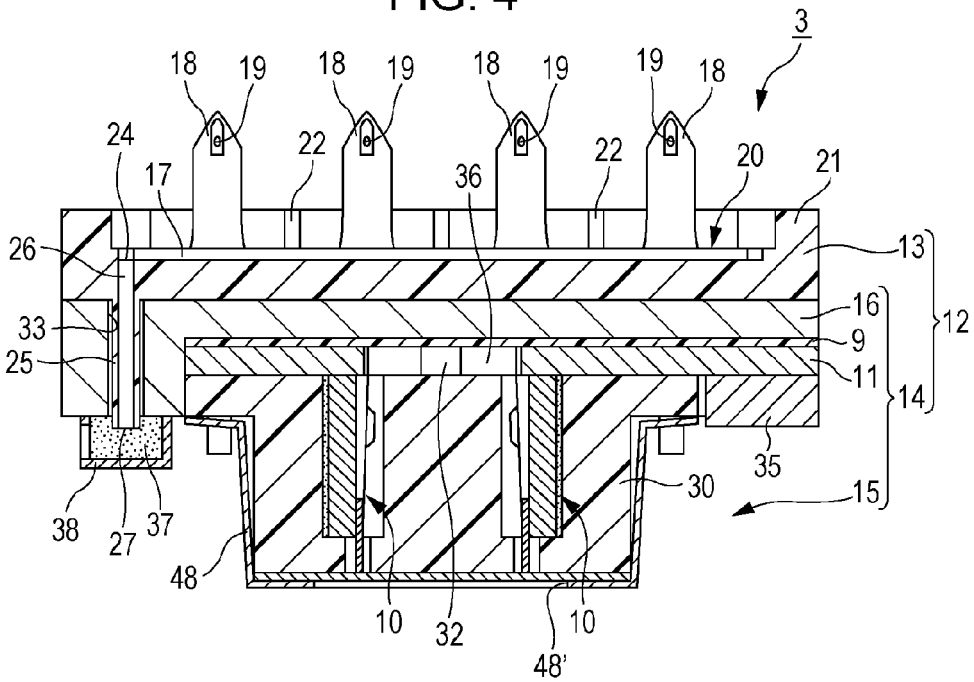
FIG. 4 is a cross section diagram taken along the line IV-IV in FIG. 3.

FIG. 2 is an exploded perspective diagram illustrating the configuration of the recording head 3. FIG. 3 is a top view (a plan view) illustrating the configuration of the recording head 3, and FIG. 4 is a cross section diagram taken along the line IV-IV in FIG. 3. The recording head 3 in the present embodiment is provided with oscillation units 10 (a type of the actuators in the invention) and a circuit board 11 in a case 12. The case 12 is formed of an introduction needle holder 13 and a carriage 14. The introduction needle holder 13 in the present invention is a member in which a plurality of ink introduction needles 18 are provided to stand on a surface (a second surface) of an opposite side from a top surface (a nozzle surface (a first surface) of a head main body 15 that is described later), and corresponds to the holder in the invention. The introduction needle holder 13 is manufactured using a synthetic resin. In the present embodiment, corresponding to four colors of the ink of the ink cartridges 7, a total of four of the ink introduction needles 18 are provided to line up along the scanning direction (the main scanning direction) of the recording head 3 on the top surface of the introduction needle holder 13.

The ink introduction needles 18 are hollow needle-shaped members that are inserted into the ink cartridges 7, and correspond to the joining sections in the invention. The ink from introduction holes 19 which are opened in the distal end portions of the ink introduction needles 18 which is stored in the ink cartridges 7 is introduced to the head main body 15 side through holder flow paths and intermediates flow path (described later). The introduction needle holder 13 is provided with a base plate 20, and a surrounding wall 21 which is provided to stand upward from the edge of all four sides of the base plate 20. The top surface of the base plate 20 is partitioned into a total of four cartridge disposition regions 23 lined up in the main scanning direction due to the provision of ribs 22 on the inside of the surrounding wall 21, and one ink introduction needle 18 is provided to stand in each of the cartridge disposition regions 23. The ink cartridges 7 are attached to the respective cartridge disposition regions 23. Note that, the configuration of introducing the ink from the ink cartridges 7 to the recording head 3 is not limited to the ink introduction needles 18, and it is possible to adopt a configuration in which, for example, porous members capable of absorbing the ink are provided on the supply side and the receiving side (the portion corresponding to the joining sections in the invention) of the ink, and the ink is transferred by bringing the porous members into contact with each other.

A total of four holder flow paths which communicate with the intermediate flow paths of an intermediate flow path member 16 (described later) are formed in the base plate 20 of the introduction needle holder 13 to correspond to each of the ink introduction needles 18 (not shown). While the top ends of the holder flow paths are open to the attachment locations of the ink introduction needles 18 to correspond to the top surface of the base plate 20, the bottom ends are open to the bottom surface of the base plate 20. Note that, since filter chambers 28 (described later) which are provided on the entrance side of each of the intermediate flow paths in the intermediate flow path member 16 are provided to line up along a direction orthogonal to the direction in which the ink introduction needles 18 are lined up (the main scanning direction), the bottom end openings of the holder flow paths are also provided corresponding to each of the filter chambers 28 to line up along a direction (the sub-scanning direction, or the nozzle row direction) which is orthogonal to the direction in which the ink introduction needles 18 are lined up (the main scanning direction). Therefore, the holder flow paths are formed oblique to the top and bottom surfaces of the introduction needle holder 13 from the corresponding ink introduction needles 18 in the introduction needle holder 13 toward the corresponding filter chambers 28. The ink which is introduced from introduction holes 19 of the ink introduction needles 18 passes through needle flow paths in the introduction needles and the holder flow paths, and is supplied to the intermediate flow paths via the filter chambers 28.

A liquid discharge inlet 24 is open in the top surface of the base plate 20 at a position which is on the inside of the surrounding wall 21 and falls outside of the region in which the ink introduction needles 18 are provided to line up, in the direction in which the needles are lined up. The liquid discharge inlet 24 is an opening of one end side (the upstream side) of a liquid discharge path 26 which extends along the width direction of the base plate 20. The liquid discharge path 26 penetrates the base plate 20 from the top surface side of the base plate 20, and is formed inside a cylindrical liquid discharge pipe 25 which protrudes downward (the nozzle surface side) from the bottom surface of the base plate 20. A liquid discharge outlet 27, which is the opening of the other end side (the downstream side) of the liquid discharge path 26, is open in the bottom end surface of the liquid discharge pipe 25. The liquid discharge pipe 25 is formed integrally with the same material (a synthetic resin) as the introduction needle holder 13, and the total length thereof is set to be longer than the plate thickness (the thickest portion) of the intermediate flow path member 16 that forms the carriage 14. In the present embodiment, a guide groove 17 which surrounds the ink introduction needles 18 is formed in the top surface of the base plate 20, and the liquid discharge inlet 24 is open inside the guide groove 17. The guide groove 17 is a groove which guides the ink that leaks from the ink introduction needle 18 side into the liquid discharge inlet 24. Accordingly, even in a rare case in which the ink leaks from the ink introduction needle 18 side, the leaked ink flowing in unintended directions or to unintended places is suppressed, and it is possible to smoothly guide the leaked ink to the liquid discharge path 26 side.

The carriage 14 is fixed to the bottom surface side of the introduction needle holder 13. The carriage 14 is formed by a plurality of members being laminated together, and, more specifically, is formed of the head main body 15, which includes a nozzle plate 46 and the oscillation units 10, the circuit board 11, and the intermediate flow path member 16. Intermediate flow paths are formed in the intermediate flow path member 16 which is positioned in the top layer of the parts of which the carriage 14 is formed. The top ends of the intermediate flow paths communicate with the introduction needle holder 13 flow paths, and the bottom ends of the intermediate flow paths communicate with case flow paths 31 (refer to FIG. 5) which are provided inside a head case 30 of the head main body 15. As illustrated in FIG. 2, the filter chambers 28, which have wider diameters than the other portions in the intermediate flow paths, are provided on the upstream side (the holder flow path side) of the intermediate flow paths, and filters 29 are attached to the bottom portions of the filter chambers 28. In other words, the ink that flows from the holder flow paths into the filter chambers 28 has foreign matter and bubbles removed therefrom by being filtered by the filters 29, and is subsequently introduced into the intermediate flow paths. The downstream ends of the intermediate flow paths on the opposite side from the filter chambers 28 are open to the bottom surface side (the head case 30 side) of the intermediate flow path member 16. An insertion hole 33, which penetrates the intermediate flow path member 16 in the plate thickness direction, is opened in the intermediate flow path member 16 at a position corresponding to the liquid discharge pipe 25 of the introduction needle holder 13. The internal diameter of the insertion hole 33 is set to be slightly larger than the external diameter of the liquid discharge pipe 25. When the introduction needle holder 13 and the intermediate flow path member 16 are joined to each other in a positioned state, the liquid discharge pipe 25 is inserted into the insertion hole 33. In the state in which the introduction needle holder 13 and the intermediate flow path member 16 are joined to each other, the bottom end of the liquid discharge pipe 25 protrudes slightly downward from the bottom surface of the intermediate flow path member 16. In other words, the liquid discharge path 26 penetrates the intermediate flow path member 16 that forms a portion of the carriage 14 and communicates with the exterior of the case 12. An absorbent material 37 formed of a porous member such as sponge is disposed at the bottom end of the liquid discharge pipe 25 in a state of blocking the liquid discharge outlet 27 of the liquid discharge path 26. The absorbent material 37 is held in a removable manner by an absorbent material holder 38 which is formed integrally with the intermediate flow path member 16, and absorbs and holds the ink that is discharged from the liquid discharge outlet 27.

The circuit board 11 is disposed between the intermediate flow path member 16 and the head case 30 of the head main body 15. The circuit board 11 is a substrate that relays drive signals, other signals, and the like that are transmitted from the printer main body side to piezoelectric elements 41. Terminal portions 34 (refer to FIG. 2) to be electrically connected to the terminal portions of flexible cables 43 are formed on the circuit board 11. A connector 35 for connecting to the printer main body side, other electronic parts, and the like are installed on the circuit board 11. In the present embodiment, two of the terminal portions 34 are formed on the top surface (the surface of the intermediate flow path member 16 side) of the circuit board 11 to correspond to the flexible cables 43 of the two oscillation units 10. A wiring member such as a flexible flat cable (FFC) is connected to the connector 35, and the circuit board 11 receives the drive signals from the printer main body side via the FFC. In the state in which the circuit board 11 is embedded in the recording head 3, the connector 35 is disposed on the opposite side in the direction in which the introduction needles are lined up from the liquid discharge path 26 side of the introduction needle holder 13.

A substrate opening 36, which penetrates the circuit board 11 in the plate thickness direction, is formed between the two terminal portions 34 in the circuit board 11. One end of the flexible cable 43 is connected to the piezoelectric elements 41, and the other end side of the flexible cable 43, which is routed from a storage space portion 40 of the head case 30, is inserted through the substrate opening 36. The substrate opening 36 is an escape hole through which flow path connecting portions 32, which are the upstream ends of the case flow paths 31 of the head case 30, are inserted. When joining the head case 30 with the intermediate flow path member 16 in a state of interposing the circuit board 11 and a sealing material 9 formed of an elastic material such as an elastomer therebetween, flow path connecting portions 32 of the head case 30 are inserted through the substrate opening 36 of the circuit board 11 and connected to the intermediate flow paths of the intermediate flow path member 16. Through-holes are opened in the sealing material 9 at positions corresponding to the connecting portions which connect the intermediate flow paths with the flow path connecting portions 32 (the case flow paths 31). The case flow paths 31 and the intermediate flow paths are communicated with each other in a liquid-tight state via the through-holes due to the circumferential edges of the through-holes making elastic contact with the corresponding opening circumferential edges of the intermediate flow paths and the opening circumferential edges of the case flow paths 31.

Figure 5:
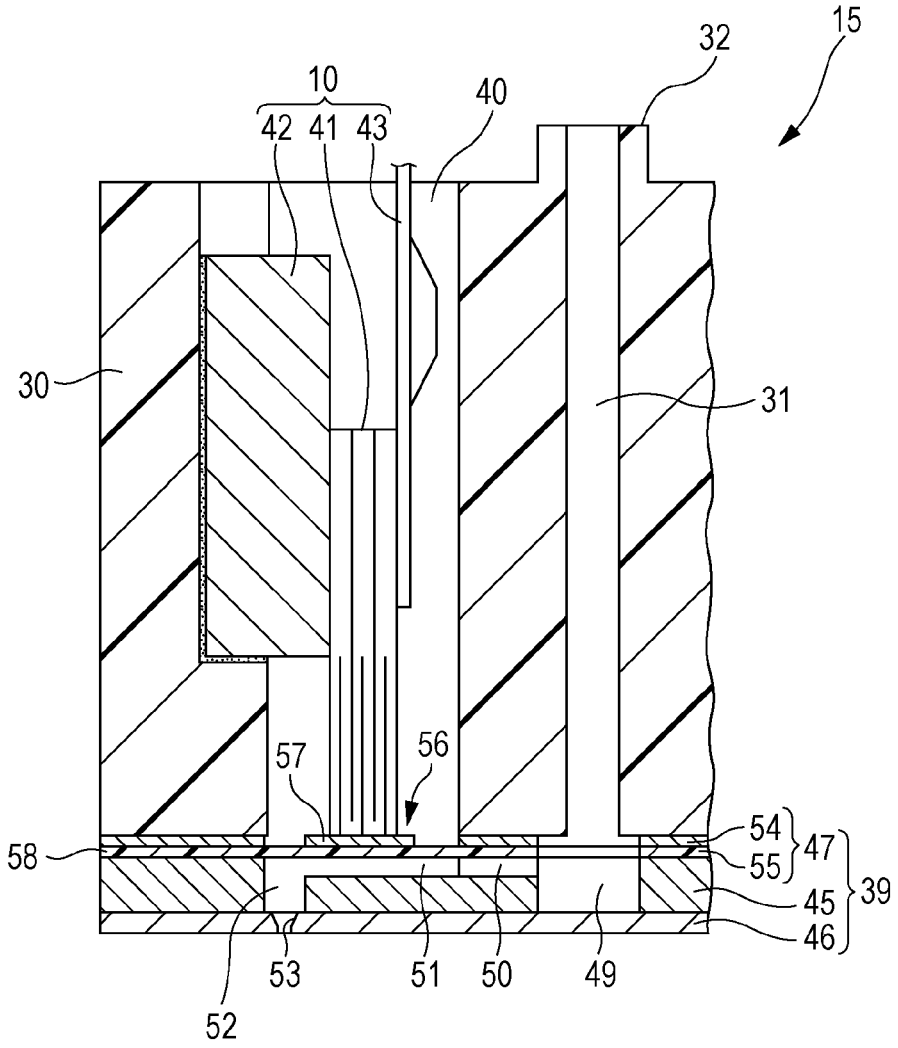
FIG. 5 is a cross section diagram of the main parts of the recording head.

FIG. 5 is a cross section diagram of the main parts for illustrating the configuration of the head main body 15. The head main body 15 is provided with the head case 30, the oscillation unit 10, a flow path unit 39, a head cover 48 (refer to FIGS. 2 and 4), and the like. The oscillation unit 10 is stored within the head case 30, the flow path unit 39 is joined to the bottom surface (the surface of the opposite side of the head case 30 from the joining surface between the head case 30 and the intermediate flow path member 16) of the head case 30. The head case 30 is manufactured from an epoxy resin, for example, and the storage space portion 40 for storing the oscillation unit 10 is formed therein. The oscillation unit 10 is provided with a piezoelectric element 41, a fixing plate 42, and a flexible cable 43. The piezoelectric element 41 functions as a type of pressure generation unit, piezoelectric element 41 is joined to the fixing plate 42, and the flexible cable 43 is for supplying the drive signals and the like to the piezoelectric element 41. The piezoelectric element 41 is a lamination-type piezoelectric element that is manufactured by alternately laminating piezoelectric layers and electrode layers to form a piezoelectric plate and cutting the piezoelectric plate into a comb-teeth shape. The piezoelectric element 41 is a vertical oscillation mode piezoelectric element capable of expanding and contracting (lateral electric field effect type) in a direction orthogonal to the lamination direction (the electric field direction).

The flow path unit 39 is formed by joining the nozzle plate 46 with one surface of a flow path forming substrate 45, and a vibrating plate 47 with the other surface of the flow path forming substrate 45. A shared liquid chamber 49 (a reservoir), an ink supply port 50, a pressure chamber 51, a nozzle communication port 52, and a nozzle 53 are provided in the flow path unit 39. A series of flow paths running from the ink supply port 50, through the pressure chamber 51 and the nozzle communication port 52, and ending at the nozzle 53 are formed to correspond to each of the nozzles 53. The nozzle plate 46 is a thin plate manufactured from a metal such as stainless steel, in which a plurality of nozzles 53 are provided as rows of holes at a pitch (for example 180 dpi) corresponding to the dot formation density. A plurality of nozzle rows (nozzle groups) in which the nozzles 53 are provided to line up are provided on the nozzle plate 46, and one nozzle row is formed of 180 of the nozzles 53, for example. The bottom surface (the surface of the side from which the ink is ejected from the nozzles 53) of the nozzle plate 46 is the nozzle surface.

The vibrating plate 47 has a two-layer overlapping structure in which the surface of a support plate 54 is laminated with an elastic film 55. In the present embodiment, the vibrating plate 47 is manufactured using a composite material in which a metal plate of stainless steel or the like is used as the support plate 54, and the surface of the support plate 54 is laminated with a resin film as the elastic film 55. A diaphragm 56 which causes the volume of the pressure chamber 51 to change is provided in the vibrating plate 47. The diaphragm 56 is manufactured by partially removing the support plate 54 using an etching process or the like. In other words, the diaphragm 56 is formed of an island portion 57 and a flexible portion 58. The distal end surface of the free-end portion of the piezoelectric element 41 is joined to the island portion 57, and the flexible portion 58 is provided in the periphery of the island portion 57. The distal end surface of the piezoelectric element 41 is joined to the island portion 57. It is possible to cause the volume of the pressure chamber 51 to fluctuate by causing the free-end portion of the piezoelectric element 41 to expand and contract.

The head cover 48 is manufactured of a metal plate material, and an exposure window 48' capable of exposing the portions of the nozzle plate 46 in which the nozzles 53 are formed is formed in the head cover 48. The head cover 48 is attached to the head case 30 so as to surround the side surfaces of the flow path unit 39 that is fixed to the head case 30. The head cover 48 functions to protect the side surfaces of the flow path unit 39, and to suppress damage to the piezoelectric elements 41 caused by static electricity that is generated from the recording paper or the like.

As illustrated in FIG. 4, in a state in which the recording head 3 is constructed and mounted on the printer 1, while the liquid discharge inlet 24 which is an opening of one end side of the liquid discharge path 26 is positioned closer to the upper ink introduction needle 18 side than the circuit board 11 in the case 12, the liquid discharge outlet 27 which is the opening of the other end side of the liquid discharge path 26 is positioned on the opposite side from the ink introduction needle 18 side to interpose the circuit board 11, that is, below the circuit board 11 (the nozzle surface side). In plan view of the recording head 3 (a state in which the recording head 3 is viewed from a direction perpendicular to the nozzle surface), the liquid discharge path 26 is provided in a position that does not overlap the circuit board 11. The connector 35 of the circuit board 11 is positioned on the opposite side from the liquid discharge path 26 side to interpose the region in which the ink introduction needles 18 are lined up. Note that, the position is not necessarily the further position from the liquid discharge path 26.

The recording head 3 that is configured as described above is attached to the printer 1 in a state in which the nozzle plate 46 faces the platen and the nozzle row direction is parallel to the sub-scanning direction (the transport direction of the recording medium 2). When the ink cartridges 7 are mounted into the cartridge disposition regions 23 which are partitioned on the top surface of the introduction needle holder 13, the ink introduction needles 18 are inserted into the cartridge, and the ink which is stored inside the cartridge is introduced to the case flow paths 31 from the flow path connecting portions 32 through the holder flow paths and the intermediate flow paths, is taken into the shared liquid chamber 49, and the ink flow paths from the shared liquid chamber 49 to the nozzle 53 are filled with the ink. When a drive signal from the control unit side of the printer 1 is relayed by the circuit board 11 and applied to the piezoelectric element 41 through the flexible cable 43, the piezoelectric element 41 is displaced through expansion or contraction according to a change in the voltage of the drive signal. According to the displacement of the piezoelectric element 41, it is possible to generate fluctuations in the pressure of the ink within the corresponding pressure chamber 51, and the ink is ejected from the nozzle 53 using the pressure fluctuations of the ink.

Here, when mounting the ink cartridges 7 into the introduction needle holder 13, or alternatively, when a vibration or another external force acts on the ink cartridges 7 or the recording head 3, there is a case in which the ink leaks from the joining portion between the ink cartridges 7 and the ink introduction needles 18. In the recording head 3 that is configured as described above, since the liquid discharge inlet 24 of the liquid discharge path 26 is open in the top surface of the introduction needle holder 13, that is, in the top surface of the base plate 20, into which the ink cartridges 7 are mounted, at a position which falls outside of the region in which the ink introduction needles 18 are provided to line up, in the direction in which the needles are lined up, the leaked ink flows down the liquid discharge path 26 from the liquid discharge inlet 24, and to outside of the case 12 from the liquid discharge outlet 27. Accordingly, even in a rare case in which the ink leaks, the leaked ink flowing to an unintended region, in particular, to the circuit board 11 in which the electronic parts are installed is suppressed. Since, while the liquid discharge inlet 24 of the liquid discharge path 26 is positioned closer to the upper ink introduction needle 18 side than the circuit board 11, the liquid discharge outlet 27 is positioned lower than the circuit board 11, that is, on the opposite side from the ink introduction needle 18 side to interpose the circuit board 11, even when the orientation of the printer 1 during installation or the orientation of the printer 1 during carrying is inclined, and in an extreme case, the orientation is vertically inverted (that is, no matter what orientation the recording head 3 assumes), the leaked ink does not easily reach the circuit board 11, and it is possible to more reliably protect the circuit board 11 from the ink. Since the absorbent material 37 is provided in the liquid discharge outlet 27, the ink, one the ink is discharged, flowing to the circuit board 11 or the like is more reliably suppressed.

Since the liquid discharge path 26 (the liquid discharge pipe 25) penetrates the intermediate flow path member 16 that forms the carriage 14 and communicates with the exterior of the case, it is possible to suppress the enlargement of the entirety of the recording head 3 in comparison to a configuration in which a liquid discharge path for allowing the ink to escape across the plurality of the components that form the recording head 3.

In the present embodiment, since the connector 35 of the circuit board 11 is positioned on the opposite side from the liquid discharge path 26 side to interpose the region in which the ink introduction needles 18 are disposed to line up therebetween, the ink does not easily flow to the connector 35 side.

Incidentally, the invention is not limited to the embodiment described above, and may be modified in various ways based on the wording of the claims.

For example, in the embodiment, a configuration is exemplified in which the liquid discharge pipe 25 which forms the liquid discharge path 26 is formed integrally with the introduction needle holder 13 of the same material; however the invention is not limited thereto, and it is possible to adopt a configuration in which the liquid discharge pipe 25 is a different material from the introduction needle holder 13, for example, a pipe member made of metal or rubber and is provided in the introduction needle holder 13.

In the embodiment described above, a configuration is exemplified in which only one of the liquid discharge paths 26 is provided; however, for example, a configuration may be adopted in which a plurality of the liquid discharge paths 26 are provided. In this case, it is preferable that each of the liquid discharge paths 26 is provided on the opposite side from the connector 35 side of the circuit board 11 to interpose the region in which the ink introduction needles 18 are lined up.

In the above description, an oscillation unit 10 is exemplified in which a so-called vertical oscillation type piezoelectric element is provided as the actuator in the invention; however, the invention is not limited thereto, and it is possible to apply the invention to configurations which adopt a so-called static electricity system actuator which displaces a portion of the pressure chamber using static electrical force, another actuator such as a heat emitting element which causes the pressure within the pressure chamber to fluctuate using bubbles that are generated within the liquid due to heating, or the like.

In the above description, description was given exemplifying an ink jet recording head 3, which is a type of the liquid ejecting head; however, it is also possible to apply the invention to another liquid ejecting head which adopts a configuration in which a joining portion which is connected to a member which supplied the liquid, an actuator as the drive source for ejecting the liquid, and a circuit board which is electrically connected to the actuator are provided in a case. For example, it is possible to apply the invention to a color material ejecting head which is used in the manufacture of a color filter of a liquid crystal display or the like, an electrode material ejecting head which is used in forming electrodes of an organic electro luminescence (EL) display, a face emission display (FED), and the like, a bio-organic matter ejecting head used in the manufacture of bio chips (biochemical elements), and the like.

What is claimed is:

1. A liquid ejecting head, comprising:

an actuator which ejects a liquid from a nozzle; and a circuit board which is electrically connected to the actuator, wherein the actuator and the circuit board are provided within a case of the liquid ejecting head, wherein the case includes a joining portion which is provided on a second surface of an opposite side from a first surface on which the nozzle is formed and which is joined with a member which supplies the liquid, and a liquid discharge path, one end of which is open in the second surface, and another side of which extends from the second surface side to the first surface side and is open toward an exterior of the case, and wherein, while an opening of one end side of the liquid discharge path is positioned closer to the joining portion side than the circuit board side in the case, an opening of another end side of the liquid discharge path is positioned on an opposite side from the joining portion side to interpose the circuit board.

2. The liquid ejecting head according to claim 1, wherein an absorbent material which absorbs the liquid is provided on the other end side of the liquid discharge path.

3. A liquid ejecting apparatus comprising the liquid ejecting head according to claim 2.

4. The liquid ejecting head according to claim 1, wherein the case is provided with a holder which includes the joining portion, and a carriage which includes the actuator and the nozzle, and wherein the liquid discharge path is provided in the holder, penetrates at least a portion of the carriage, and communicates with the exterior of the case.

5. A liquid ejecting apparatus comprising the liquid ejecting head according to claim 4.

6. The liquid ejecting head according to claim 1, wherein the circuit board includes a connector to which wiring is connected, and wherein the connector is positioned on an opposite side from the liquid discharge path side to interpose the joining portion.

7. The liquid ejecting head according to claim 6, wherein the circuit board is disposed between the holder and the carriage.

8. A liquid ejecting apparatus comprising the liquid ejecting head according to claim 7.

9. A liquid ejecting apparatus comprising the liquid ejecting head according to claim 6.

10. A liquid ejecting apparatus comprising the liquid ejecting head according to claim 1.

* * * * *